US007487991B2

(12) United States Patent
Degasperi et al.

(10) Patent No.: US 7,487,991 B2
(45) Date of Patent: Feb. 10, 2009

(54) GLIDING BOARD

(75) Inventors: Lionel Degasperi, Saint Etienne de Crossey (FR); Jean-Claude Meyer, Chirens (FR); Thierry Monnet, Izeaux (FR); Philippe Largueze, Grenoble (FR)

(73) Assignee: Skis Rossignol S.A.S., Moirans (FR)

( * ) Notice: Subject to any disclaimer, the term of this patent is extended or adjusted under 35 U.S.C. 154(b) by 520 days.

(21) Appl. No.: 11/053,417

(22) Filed: Feb. 9, 2005

(65) Prior Publication Data

US 2005/0248126 A1 Nov. 10, 2005

(30) Foreign Application Priority Data

May 5, 2004 (FR) ..... 04 50866

(51) Int. Cl.
*A63C 5/00* (2006.01)

(52) U.S. Cl. ..... 280/607; 280/14.22; 280/602; 280/610; 280/609; 280/633; 280/611

(58) Field of Classification Search ..... 52/782.21, 52/783.1, 105; 280/14.22, 619, 607–610, 280/601–602, 633
See application file for complete search history.

(56) References Cited

U.S. PATENT DOCUMENTS

| | | | | |
|---|---|---|---|---|
| 4,270,768 | A * | 6/1981 | Nakanishi | 280/610 |
| 4,747,613 | A * | 5/1988 | Brichoud et al. | 280/611 |
| 5,016,901 | A * | 5/1991 | Mayr | 280/607 |
| 5,141,243 | A * | 8/1992 | Meatto | 280/602 |
| 5,573,264 | A * | 11/1996 | Deville et al. | 280/602 |
| 6,102,428 | A * | 8/2000 | Bobrowicz | 280/607 |
| 6,217,041 | B1 * | 4/2001 | Hauser et al. | 280/14.22 |
| 6,309,586 | B1 * | 10/2001 | Colley et al. | 264/510 |
| 6,478,917 | B1 * | 11/2002 | Magoni et al. | 156/245 |
| 6,554,297 | B2 * | 4/2003 | Phillips et al. | 280/14.22 |
| 6,679,514 | B2 * | 1/2004 | Luitz et al. | 280/607 |
| 6,688,632 | B2 * | 2/2004 | Merino et al. | 280/609 |
| 6,886,848 | B2 * | 5/2005 | Riepler | 280/602 |
| 7,011,331 | B2 * | 3/2006 | Riepler | 280/601 |
| 7,021,648 | B2 * | 4/2006 | Deborde et al. | 280/607 |
| 7,216,887 | B2 * | 5/2007 | Riepler | 280/608 |
| 7,261,791 | B2 * | 8/2007 | Chaumat et al. | 156/245 |
| 7,314,227 | B2 * | 1/2008 | Sanders | 280/602 |
| 7,316,411 | B2 * | 1/2008 | Spanier et al. | 280/610 |
| 7,404,564 | B2 * | 7/2008 | Bregeon et al. | 280/14.21 |

FOREIGN PATENT DOCUMENTS

| | | |
|---|---|---|
| EP | 0 774 280 A1 | 5/1997 |
| EP | 1 247 550 A1 | 10/2002 |
| FR | 2 741 011 A1 | 5/1997 |

* cited by examiner

*Primary Examiner*—Richard E. Chilcot, Jr.
*Assistant Examiner*—Chi Q Nguyen
(74) *Attorney, Agent, or Firm*—Browdy and Neimark, P.L.L.C.

(57) ABSTRACT

A board (1) for gliding, in particular on snow, having a protective upper layer (3) covering the internal structure of the board, including the core (5) and any reinforcements (10), wherein:

it has a metal plate (2) arranged between the protective upper layer (3) and the internal structure of the board, said plate (2) is located level with a transparent region (4) of the protective upper layer (3), said plate (2) has at least one recess (12) formed on its upper face, inside which the material of the protective upper layer (3) penetrates.

9 Claims, 1 Drawing Sheet

GLIDING BOARD

TECHNICAL FIELD

The invention concerns the field of snow gliding sports. It relates more particularly to a board structure incorporating a metal element which can be seen through the protective upper layer, providing particularly attractive 3D decorative effects.

PRIOR ART

In general, a snow gliding board such as a ski has an internal structure which is composed of a core, optionally covered with one or more generally fibrous reinforcements. This internal structure is covered with a protective upper layer, which generally comprises the decoration of the upper face. This decoration may be obtained by various colored patterns, which can be seen through this protective upper layer, being screenprinted on the lower face of this layer.

It will be understood that screenprinting methods can produce a wide variety of patterns, but these are exclusively flat since they are formed on the lower face of this protective layer. In certain cases, relief effects can be obtained when the lower face of the protective layer is deformed by the texture of the underlying fibrous reinforcement. These deformations, however, have very limited patterns because they are generated by slight variations in the thickness of the reinforcement, which is generally a textile structure.

It is therefore an object of the invention to make it possible to form a decorative effect by means of elements which are easy to process in the scope of board manufacturing methods, and which make it readily possible to obtain many relief effects.

DESCRIPTION OF THE INVENTION

The invention therefore relates to a board for gliding, in particular on snow, having a protective upper layer covering the internal structure of the board. This internal structure includes a core and optionally reinforcements.

According to the invention, this board is one which has a metal plate arranged between the protective upper layer and the internal structure of the board. This plate is located level with a transparent region of the protective upper layer, that is to say in a region through which the underlying elements can be seen. This plate has at least one recess which is formed on its upper face, and inside which the material of the protective upper layer penetrates.

In other words, the characteristic plate has hollow regions which can be seen from on top of the board, these hollow regions being partially or completely filled with the polymer material which forms the protective upper layer. In this way, by substantially adopting the shape of the hollow regions, this material generates menisci which increase the perception of relief by lens effects.

The use of metallic materials for the board makes it possible to obtain reflective effects which can vary according to the degree of polishing or burnishing, or more generally the surface condition of the board. This metal piece also has the advantage of withstanding the high pressures and temperatures encountered during the various operations employed for manufacturing the board, in particular injection molding operations.

In practice, it is possible to produce hollow regions which adopt widely varied patterns. In particular, it is possible to produce recesses which pass fully through, and which therefore reveal the internal structure of the board through the protective upper layer. These recesses may be formed in various ways, and in particular by machining or preferably by chemical etching.

In practice, the material used to form the plate will be based on a metal selected from the group comprising aluminum, stainless steel, nickel or brass, in particular. These metals may be used on their own or as an alloy. In particular, the alloys known by the name ARCAP (based on copper, nickel, tin, zinc, manganese, aluminum, lead, iron or titanium) may be mentioned. The plate may have a thickness of between 0.1 and 0.8 millimeters, depending on the depth of the patterns which are intended to be produced.

In practice, the plate may be bonded under the protective upper layer by means of a hot-melt adhesive film, thus allowing the protective upper layer to be handled during the operations of placing in a mold.

In the particular case in which the recesses of the plate pass fully through and the board includes a reinforcement, this reinforcement may penetrate partially inside the recess of the plate and in turn form a meniscus which enhances the relief effects.

In practice, the upper face of the board may preferably also have a mark for identifying the board, which may be individually formed by using the etching or machining methods as mentioned above.

BRIEF DESCRIPTION OF THE FIGURES

The way in which the invention may be embodied, and the advantages which this offers, will become readily apparent from the following description of the embodiments with reference to the appended figures, in which:

FIGS. 2 and 3 are sectional views of a gliding board equipped with characteristic plates having recesses, which respectively do and do not pass fully through.

EMBODIMENTS OF THE INVENTION

As already mentioned, the invention may be applied to various types of gliding board, and in particular skis or snowboards.

Figure 1:
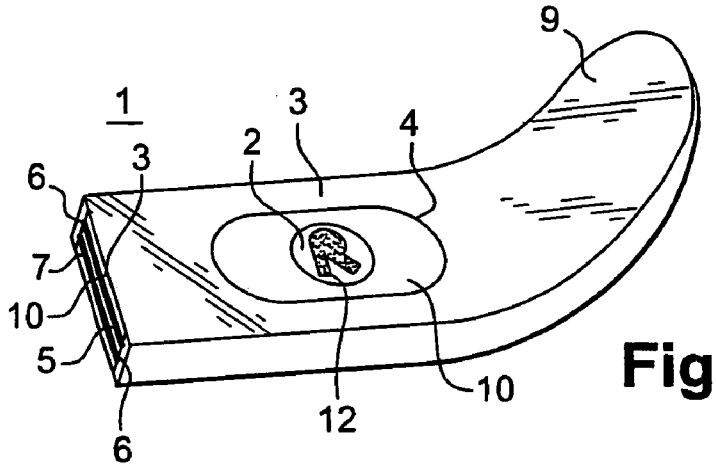
FIG. 1 is an overall schematic perspective view of the front region of a ski equipped with the characteristic plate.

The front of the ski (1) as illustrated in FIG. 1 has a characteristic plate (2) arranged under the protective upper layer (3), in a region (4) where the latter is transparent. More precisely, this protective upper layer (3) covers the board's internal structure formed by the core (5), optional side reinforcing elements (6) and a base surface. Other types of structure may nevertheless be provided with a protective upper layer (3), so that the invention is not limited to the form illustrated in FIG. 1.

The protective upper layer (3), which is based on a conventional polymer material, generally has a layer of varnish or other pigment defining entirely flat patterns on its lower face.

The absence of this varnish layer on the transparent region (4) makes it possible to expose the reinforcement (10), which generally consists of a fibrous web, and for example a glass fiber-based fabric impregnated with an epoxy resin or a thermoplastic resin.

Figure 2:
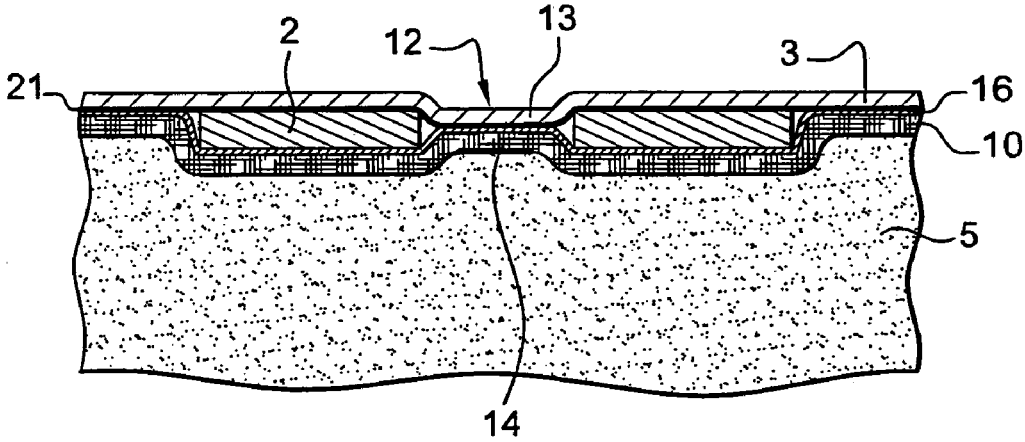

As illustrated more precisely in FIG. 2, the characteristic plate (2) has a recess (12) hollowed through the plate (2). This recess may be formed in various ways, in particular using the chemical etching techniques by which it is also possible to control the depth of the recess. Other machining techniques or even laser etching may be employed, especially in the case in which the recess (12) passes fully through as illustrated in FIG. 2.

Chemical etches involving various successive masking steps can make it possible to generate recesses having a plurality of depth levels, thus increasing the relief effects.

As illustrated in FIG. 2, the protective upper layer (3) tends to penetrate slightly inside the recess (12) during the molding operations, so as to form a hollow region or meniscus. This meniscus (13) comes in contact with a complementary meniscus (14) formed in the reinforcing layer (10) which penetrates into the recess (12) from below.

An adhesive film (21) allows the plate (2) to be bonded under the protective upper layer (3), making it easier to handle the assembly during the molding operations.

If the reinforcement (10) is pre-impregnated with a resin, a barrier film (16) will be interposed between the reinforcement (10) and the protective upper layer (3) so that it passes under the plate (2). This barrier film (16) makes possible to prevent any migration and aggregation of resin under the protective upper layer (3).

As already mentioned, the meniscus (14) formed by the reinforcement (10) level with the recess (12) makes it commensurately easier to see the curvature of its constituent fibers the more the meniscus (13) of the protective upper layer acts as a lens.

Figure 3:
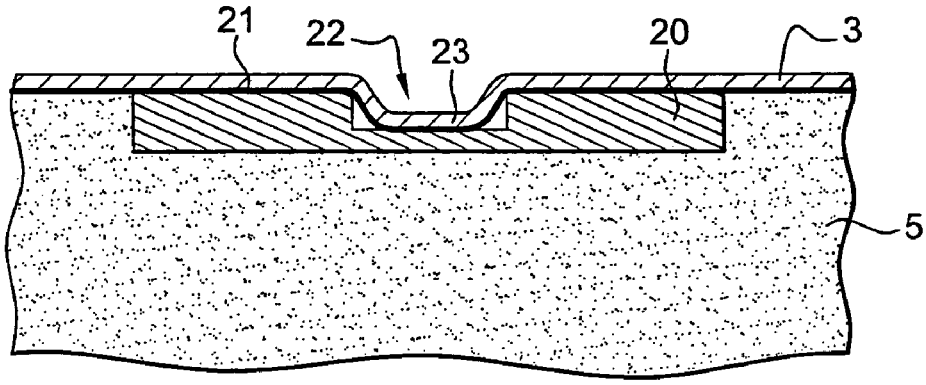

Relief effects can also be obtained by using plates which have recesses not passing fully through, as illustrated in FIG. 3. Such a recess (22) is slightly filled with the meniscus (23) formed by the protective layer (3). To make it easier to position the plate (20), an adhesive film (21) may be placed on the upper face of the plate (20) so as to bond the lower face of the protective upper layer (3).

Many patterns may be produced on the exposed face of the characteristic plate. Among these patterns, distinctive signs may be provided for the logo of the manufacturer of the board.

In a more personalized version, distinctive signs may be provided in order to identify whichever rental or leisure organization owns the gliding board. At a higher level of personalization, these patterns may include an individual and unique indication, therefore allowing the ski to be identified by the number or name of its owner, if applicable. This identification has the benefit of being tamper-proof, since it would be necessary to destroy the protective upper layer in order to remove it.

It is clear from the above description that the boards according to the invention have the advantage that they can be provided with decorative effects having three-dimensional features, while being relatively simple to produce.

The invention claimed is:

1. A board (1) for gliding, in particular on snow, comprising;

a protective upper layer (3) having an integral transparent region (4) formed as a unit with the protective upper layer (3), wherein the protective upper layer (3) is located above an internal structure of the board which includes a core (5) and reinforcements (10), a single metal plate (2) arranged below and abutting the protective upper layer (3) and over the internal structure of the board, wherein said single metal plate (2) has at least one recess (12) formed through an upper face thereof, and wherein the transparent region (4) of the protective upper layer (3) projects into the at least one recess and is located in the same plane with the single metal plate (2).

2. The gliding board as claimed in claim 1, wherein the at least one recess extends through and reveals the internal structure of the board through the transparent region of the protective upper layer (3).

3. The gliding board as claimed in claim 1, wherein the metal plate (2) is bonded under the protective upper layer (3) by means of an adhesive film (21).

4. The gliding board as claimed in claim 1, wherein the internal structure has at least one reinforcement (10), wherein the reinforcement (10) which lies below the protective upper layer (3) penetrates partially inside the recess (12) of the plate (2).

5. The gliding board as claimed in claim 4, wherein a film (16) interposed between the metal plate (2) and the reinforcement (10).

6. The gliding board as claimed in claim 1, wherein the recess is formed by chemical etching.

7. The gliding board as claimed in claim 1, wherein the metal plate is made of a material based on a metal selected from a group comprising aluminum, stainless steel and brass.

8. The gliding board as claimed in claim 1, wherein the plate has a thickness of between 0.1 and 0.8 mm.

9. The gliding board as claimed in claim 1, wherein the upper face of the plate (2) has a mark for identifying the board.

* * * * *